US007677397B2

(12) United States Patent
Bjornson et al.

(10) Patent No.: US 7,677,397 B2
(45) Date of Patent: Mar. 16, 2010

(54) SIZING ROLLER SCREEN ORE PROCESSING APPARATUS

(75) Inventors: Brad Bjornson, Fort McMurray (CA); Doug Cox, Fort McMurray (CA); Paul MacDougall, Fort McMurray (CA); Garth Booker, Fort McMurray (CA)

(73) Assignee: Suncor Energy Inc., Alberta (CA)

( * ) Notice: Subject to any disclaimer, the term of this patent is extended or adjusted under 35 U.S.C. 154(b) by 187 days.

(21) Appl. No.: 11/187,977

(22) Filed: Jul. 25, 2005

(65) Prior Publication Data

US 2006/0021915 A1 Feb. 2, 2006

(30) Foreign Application Priority Data

Jul. 30, 2004 (CA) ..... 2476194

(51) Int. Cl.
*B07C 5/12* (2006.01)
*B07B 13/00* (2006.01)

(52) U.S. Cl. ..... 209/672; 209/665; 209/667; 209/671

(58) Field of Classification Search ..... 209/665, 209/667, 671, 672; 241/21, 62
See application file for complete search history.

(56) References Cited

U.S. PATENT DOCUMENTS

| | | | | | |
|---|---|---|---|---|---|
| 528,974 | A | | 11/1894 | Pike | |
| 1,930,247 | A | * | 10/1933 | Mccormick | 241/17 |
| 2,606,861 | A | * | 8/1952 | Eastwood | 208/55 |
| 2,674,564 | A | * | 4/1954 | Hermanson | 208/26 |
| 2,894,824 | A | * | 7/1959 | Lanning | 422/137 |
| 3,159,562 | A | | 1/1964 | Bichard et al. | 208/11 |
| 3,161,483 | A | * | 12/1964 | Morris | 34/580 |
| 3,260,548 | A | | 7/1966 | Reichl | |
| 3,392,105 | A | | 7/1968 | Poettmann | 208/11 |

(Continued)

FOREIGN PATENT DOCUMENTS

| | | |
|---|---|---|
| CA | 857305 | 1/1970 |

(Continued)

OTHER PUBLICATIONS

Keller, Noble and Gaffey "A Unique, Reagent-Based, Separation Method for Tar Sands and Environmental! Clean Ups" Presented to AIChE 2001 Annual Meeting Nov. 6, 2001 Reno, Nevada.

(Continued)

*Primary Examiner*—Patrick H Mackey
*Assistant Examiner*—Terrell H Matthews
(74) *Attorney, Agent, or Firm*—Townsend and Townsend and Crew LLP

(57) ABSTRACT

Discloses a mined ore processing apparatus to process mined ores, such as oil sands ore, into granular material. An ore processor bed receives the ore to be processed. The ore processor bed has a frame supporting several rotating elements each separately driven to provide independent rotation rate and direction from the other. The ore processing bed is operable as a sizing device to decimate mined ore supply into granular material and separating it from rocks and other large lump mineral materials found in situ. The ore processing bed may be oriented to provide an upward inclination, which, when combined with alternating rotating element rotation directions, provides a crushing action to the ore material to crush larger rock. Alternately, a rock crusher is also provided to disintegrate oversized materials.

25 Claims, 5 Drawing Sheets

U.S. PATENT DOCUMENTS

| | | | | | |
|---|---|---|---|---|---|
| 3,402,896 | A | | 9/1968 | Daman | 241/38 |
| 3,509,641 | A | | 5/1970 | Smith et al. | 34/134 |
| 3,581,875 | A | * | 6/1971 | Guis | 198/782 |
| 3,933,651 | A | | 1/1976 | Erskine | 210/400 |
| 3,941,425 | A | | 3/1976 | Reichl | |
| 3,972,861 | A | | 8/1976 | Gardner, Jr. et al. | 260/123.5 |
| 3,998,702 | A | | 12/1976 | Opoku | 196/14.52 |
| 4,029,568 | A | * | 6/1977 | Pittman et al. | 208/415 |
| 4,103,972 | A | | 8/1978 | Kochanowsky et al. | 299/18 |
| 4,120,776 | A | | 10/1978 | Miller et al. | 208/11 |
| 4,139,646 | A | | 2/1979 | Gastrock | 426/430 |
| 4,244,165 | A | * | 1/1981 | McElwain | 56/327.1 |
| 4,424,113 | A | | 1/1984 | Mitchell | 208/11 |
| 4,486,294 | A | | 12/1984 | Miller et al. | 208/11 |
| 4,505,516 | A | | 3/1985 | Shelton | 299/2 |
| 4,505,811 | A | | 3/1985 | Griffiths et al. | 209/13 |
| 4,512,956 | A | | 4/1985 | Robinson et al. | 422/270 |
| 4,538,734 | A | | 9/1985 | Gill | 209/668 |
| 4,549,935 | A | | 10/1985 | Tchernyak | 196/14.52 |
| 4,585,180 | A | | 4/1986 | Potts | 241/186 |
| 4,658,964 | A | * | 4/1987 | Williams | 209/552 |
| 4,733,828 | A | | 3/1988 | Potts | 241/236 |
| 4,741,444 | A | | 5/1988 | Bielagus | 209/672 |
| 4,763,845 | A | | 8/1988 | Guggenheimer et al. | 241/101.7 |
| 4,781,331 | A | | 11/1988 | Potts | 241/236 |
| 4,795,036 | A | | 1/1989 | Williams | |
| 4,799,627 | A | | 1/1989 | Potts | 241/236 |
| 4,851,123 | A | | 7/1989 | Mishra | 210/609 |
| 4,994,097 | A | | 2/1991 | Brouwers | 55/317 |
| 5,039,227 | A | * | 8/1991 | Leung et al. | 366/137 |
| 5,117,983 | A | | 6/1992 | Marrs | |
| 5,124,008 | A | | 6/1992 | Rendall et al. | 204/61 |
| 5,143,598 | A | | 9/1992 | Graham et al. | 208/390 |
| 5,161,744 | A | | 11/1992 | Maurer Horst et al. | 241/101.7 |
| 5,186,820 | A | | 2/1993 | Schultz et al. | 209/164 |
| 5,242,580 | A | | 9/1993 | Sury | 208/400 |
| 5,257,699 | A | | 11/1993 | Fricker et al. | 209/672 |
| 5,264,118 | A | * | 11/1993 | Cymerman et al. | 208/390 |
| 5,441,206 | A | | 8/1995 | Schade et al. | 241/81 |
| 5,450,966 | A | | 9/1995 | Clark et al. | |
| 5,480,566 | A | | 1/1996 | Strand | 210/772 |
| 5,503,712 | A | | 4/1996 | Brown | |
| 5,589,599 | A | * | 12/1996 | McMullen et al. | 585/240 |
| 5,645,714 | A | | 7/1997 | Strand et al. | 208/391 |
| 5,723,042 | A | | 3/1998 | Strand et al. | 208/391 |
| 5,772,127 | A | * | 6/1998 | Maciejewski et al. | 241/21 |
| 5,954,277 | A | | 9/1999 | Maciejewski et al. | |
| 6,033,187 | A | | 3/2000 | Addie | 417/18 |
| 6,065,607 | A | * | 5/2000 | Magnusson et al. | 209/665 |
| 6,076,753 | A | | 6/2000 | Maciejewski et al. | |
| 6,250,476 | B1 | * | 6/2001 | Kroon et al. | 209/272 |
| 6,318,560 | B2 | * | 11/2001 | Davis | 209/672 |
| 6,319,099 | B1 | | 11/2001 | Akihiro et al. | 451/60 |
| 6,322,845 | B1 | | 11/2001 | Dunlow | 426/629 |
| 6,390,915 | B2 | * | 5/2002 | Brantley et al. | 460/131 |
| 6,450,775 | B1 | | 9/2002 | Hutchinson et al. | 417/198 |
| 6,460,706 | B1 | | 10/2002 | Davis | |
| 6,517,733 | B1 | | 2/2003 | Carlson | 210/785 |
| 6,521,079 | B1 | | 2/2003 | Roy | 156/345.1 |
| 6,585,560 | B2 | | 7/2003 | Tanoue et al. | 451/5 |
| 6,648,145 | B2 | | 11/2003 | Davis et al. | 209/672 |
| 6,800,116 | B2 | | 10/2004 | Stevens et al. | 95/262 |
| 6,818,058 | B2 | | 11/2004 | Ronin | 106/705 |
| 6,821,060 | B2 | | 11/2004 | McTurk et al. | 406/137 |
| 7,008,966 | B2 | | 3/2006 | Degeorge et al. | 518/700 |
| 7,013,937 | B2 | | 3/2006 | Potts | 141/387 |
| 7,111,738 | B2 | | 9/2006 | Allen, III | 209/172 |
| 7,207,504 | B2 | | 4/2007 | Willmot | 241/5 |
| 7,399,406 | B2 | | 7/2008 | Mikula et al. | 208/390 |
| 7,556,715 | B2 | | 7/2009 | Gaston et al. | 196/14.52 |
| 2002/0018842 | A1 | | 2/2002 | Dunlow | 426/630 |
| 2003/0089644 | A1 | * | 5/2003 | Hanks | 209/665 |
| 2004/0251731 | A1 | | 12/2004 | Potts | 299/18 |
| 2004/0262980 | A1 | | 12/2004 | Watson | 299/8 |
| 2005/0051500 | A1 | * | 3/2005 | Price et al. | 210/767 |
| 2005/0134102 | A1 | * | 6/2005 | Cymerman et al. | 299/7 |
| 2005/0161372 | A1 | | 7/2005 | Colic | 208/391 |
| 2005/0173726 | A1 | | 8/2005 | Potts | 257/134 |
| 2006/0091249 | A1 | | 5/2006 | Potts | 241/236 |
| 2007/0014905 | A1 | | 1/2007 | Chen et al. | 426/490 |
| 2007/0095032 | A1 | | 5/2007 | Pal et al. | 55/418 |
| 2007/0180741 | A1 | | 8/2007 | Bjornson et al. | 37/403 |
| 2007/0180951 | A1 | * | 8/2007 | Armstrong et al. | 75/367 |
| 2008/0047198 | A1 | | 2/2008 | Mehlhose et al. | 48/210 |
| 2008/0121493 | A1 | | 5/2008 | Bjornson et al. | 198/301 |
| 2008/0173572 | A1 | | 7/2008 | Bjornson et al. | 208/391 |

FOREIGN PATENT DOCUMENTS

| | | |
|---|---|---|
| CA | 841581 | 12/1970 |
| CA | 890903 | 1/1972 |
| CA | 917585 | 12/1972 |
| CA | 918588 | 1/1973 |
| CA | 922655 | 3/1973 |
| CA | 997300 | 9/1976 |
| CA | 1085762 | 9/1980 |
| CA | 1088883 | 11/1980 |
| CA | 1106789 | 8/1981 |
| CA | 1117353 | 2/1982 |
| CA | 1126187 | 6/1982 |
| CA | 1132511 | 9/1982 |
| CA | 1137906 | 12/1982 |
| CA | 1163257 | 3/1984 |
| CA | 1193586 | 9/1985 |
| CA | 1153347 | 9/1986 |
| CA | 1214421 | 11/1986 |
| CA | 1231692 | 1/1988 |
| CA | 1266261 | 2/1990 |
| CA | 1309050 | 10/1992 |
| CA | 2116243 | 3/1993 |
| CA | 2000984 | 11/1994 |
| CA | 2029795 | 11/1996 |
| CA | 2105176 | 5/1997 |
| CA | 2164925 | 6/1997 |
| CA | 2294860 | 6/1998 |
| CA | 2235938 | 10/1998 |
| CA | 2088227 | 2/1999 |
| CA | 2217623 | 4/1999 |
| CA | 2249679 | 4/1999 |
| CA | 2250623 | 4/1999 |
| CA | 2220821 | 5/1999 |
| CA | 2254048 | 5/1999 |
| CA | 2227667 | 7/1999 |
| CA | 2195604 | 11/1999 |
| CA | 2290029 | 8/2000 |
| CA | 2332207 | 2/2002 |
| CA | 2084375 | 7/2002 |
| CA | 2227667 | 11/2002 |
| CA | 2358805 | 2/2003 |
| CA | 2235938 | 4/2003 |
| CA | 2352274 | 4/2003 |
| CA | 2398026 | 6/2003 |
| CA | 2498862 | 7/2003 |
| CA | 2518040 | 9/2003 |
| CA | 2436818 | 2/2004 |
| CA | 2441969 | 5/2004 |
| CA | 2522514 | 11/2004 |
| CA | 2554725 | 4/2005 |
| CA | 2486137 | 5/2005 |
| CA | 2548370 | 5/2005 |
| CA | 2548371 | 5/2005 |
| CA | 2558059 | 8/2005 |
| CA | 2476194 | 1/2006 |
| CA | 2480122 | 3/2006 |

| | | |
|---|---|---|
| CA | 2520943 | 4/2006 |
| CA | 2549895 | 6/2006 |
| CA | 2558059 | 8/2006 |
| CA | 2506398 | 11/2006 |
| CA | 2552031 | 1/2007 |
| CA | 2520821 | 3/2007 |
| CA | 2526336 | 5/2007 |
| CA | 2567643 | 5/2007 |
| CA | 2567644 | 5/2007 |
| CA | 2453697 | 4/2008 |
| CA | 2610124 | 5/2008 |
| CA | 2610169 | 5/2008 |
| DE | 2834987 | 2/1980 |
| DE | 3936681 | 5/1990 |
| EP | 0167178 | 4/1990 |
| EP | 493858 | 6/1995 |
| FR | 2185027 | 5/1973 |
| GB | 1437605 | 6/1976 |
| GB | 2010777 | 7/1979 |
| GB | 0401933-1 | 1/2005 |
| GB | 0406802-9 | 1/2005 |
| JP | 0005096492 | 4/1993 |
| WO | WO 83/00318 | 2/1983 |
| WO | WO 83/02071 | 6/1983 |
| WO | WO 83/03062 | 9/1983 |
| WO | WO 83/03444 | 10/1983 |
| WO | WO 88/01201 | 8/1987 |
| WO | WO 96/29149 | 9/1996 |
| WO | WO 98/58739 | 12/1998 |
| WO | WO 99/54049 | 10/1999 |
| WO | WO 00/10896 | 3/2000 |
| WO | WO 00/35585 | 6/2000 |
| WO | WO 02/092231 | 11/2002 |
| WO | WO 03/006165 | 1/2003 |
| WO | WO 03/056134 | 7/2003 |
| WO | 03074394 | 9/2003 |
| WO | WO 2004/005673 | 1/2004 |
| WO | WO 2004/094061 | 11/2004 |
| WO | 05000454 | 1/2005 |
| WO | WO 2005/046874 | 5/2005 |
| WO | WO 2005/046875 | 5/2005 |
| WO | WO 2005/072877 | 8/2005 |
| WO | WO 2006/035209 | 4/2006 |

OTHER PUBLICATIONS

The Fine Tailings Fundamentals Consortium "Advances in Oil Sands Tailings Research" ISBN 0/7732-1691-X Published by Alberta Department of Energy Jun. 1995.

Stausz et al, "The Chemistry of Alberta Oil Sands, Bitumens and Heavy Oils —Chapter 4 —Composition and Structure of Alberta Oil Sands and Oil Carbonates", Alberta Energy Research Institue, 2003, pp. 29-67.

Restriction Requirement dated Dec. 12, 2008 for U.S. Appl. No. 11/595,817.

Office Action dated Mar. 2, 2009 for U.S. Appl. No. 11/595,817.

Office Action dated May 23, 2008 for U.S. Appl. No. 11/558,340.

Restriction Requirement dated Dec. 2, 2008 for U.S. Appl. No. 11/558,340.

Office Action dated Apr. 29, 2009 for U.S. Appl. No. 11/558,340.

Office Action dated Apr. 28, 2009 for U.S. Appl. No. 11/558,303 - Restriction Requirement.

Office Action dated Nov. 12, 2008 for U.S. Appl. No. 11/558,303.

Office Action dated Jul. 21, 2009 for U.S. Appl. No. 11/595,817.

Natural Resources Canada, Treatment of Bitumen Froth and Slop Oil Tailings.

National Energy Board, Canada's Oil Sands: A Supply and Market Outlook to 2015, An Energy Market Assessment Oct. 2000.

Office Action dated Jan. 26, 2007 for U.S. Appl. No. 10/825,230.

Office Action dated Oct. 3, 2007 for U.S. Appl. No. 10/825,230.

Office Action dated Jun. 20, 2008 for U.S. Appl. No. 10/825,230.

Notice of Allowability dated May 8, 2009 for U.S. Appl. No. 10/825,230.

Rimmer, Gregoli and Yildlrim, "Hydrocyclone-based Process for Rejecting Solids from Oil Sands at the Mine Site While Retaining Bitumen for Transportation to a Processing Plant"; Suncor Extraction 3rd f1 pp. 93-100, Paper delivered on Monday Apr. 5, 1993 at a conference in Alberta, Canada entitled "Oil Sands-Our Petroleum Future".

Office Action dated Apr. 13, 2007 for CA Application No. 2476194.

Office Action dated Jul. 29, 2008 for CA Application No. 2476194.

Office Action dated Jun. 2, 2009 for CA Application No. 2476194.

Printed publication namely Screen printed (5 pages) electronic brochure from the website of Roxon Equipment. Date display "Feb 1, 2004" (brochure screen printed Jan. 27, 2004) along with 23 screen-printed pages from the web site for www.roxongroup.com archived by the Web Archive (http://web.archive.org).

* cited by examiner

SIZING ROLLER SCREEN ORE PROCESSING APPARATUS

This invention relates to the processing of mined ore and more particularly relates to sizing and conditioning of mined ore materials.

BACKGROUND OF THE INVENTION

Earth formations are mined to recover valuable minerals that are incorporated in the earthen formations or are covered by an earthen overburden. For example, Northern Alberta has oil sands formations that contain valuable bitumen hydrocarbons. Various techniques are in use or have been discussed for recovery of bitumen hydrocarbons from oil sands formations. In accordance with one method of recovery, the oil sands formations are mined to remove in situ bitumen bearing ore from the formation in which it is found. The removed oil sands ore is then processed to separate the hydrocarbons from the sand and mineral materials. Once separated, the hydrocarbons are then further processed into intermediate or finished products such as synthetic crude oil, fuels and the like.

When the mining method of extraction is employed, the oil sands ore extracted from the earth is transported to a processing facility where separation of the bitumen hydrocarbons from the other materials in the ore can take place. The mined oil sands ore is typically transported to processing facilities by truck or by slurry transport via a pipeline or by combinations of the two or by other mechanisms. Frequently, the oil sands ore is mined at a considerable distance from where the process of separating the oil sands into hydrocarbons, sand and minerals takes, place. Distance affects conditioning and recovery in hydrotransport systems, consequently, transport of the mined ore to a separation facility typically involves transporting the mined ore significant distances. Moreover, the location from which the ore is taken changes over time as the oil sands ore is depleted as a result of formation mining, consequently resulting in migration of the mining site along the formation. Because the location of the source of oil sands ore changes over time, the ore transport start point at the mining site must be mobile to permit the ore to begin transport from the source formation site as that changes over time.

One mechanism for transport of the ore to the separation facility is by forming the mined ore into a slurry. Suitable solvents, for example water, are mixed with the processed ore to form a slurry and the slurry produced is then transported to a separation processing facility over a pipeline. To prepare the ore for slurry transport, the mined ore is preferably comminuted into the smaller particle size to facilitate transport by slurry pumping. Furthermore, large rocks and other undesirable oversized solids are not candidate slurry components. In one manner of operation these oversized solids are removed or separated from the processed ore that is to be formed into a slurry. In another manner of operation these oversized solids are crushed and included with the processed ore that is to be formed into a slurry. Because the location where the ore is extracted from will change over time, it is preferable to have readily movable slurry equipment to reduce the need for long transport from the mining area to the slurry processing equipment.

SUMMARY OF THE INVENTION

The present invention provides a mined ore processing apparatus that is operable as a sizing device in either a wet or dry process that screens, sorts and comminutes mined ore into granular material separating it from rocks and other large lump mineral materials found in situ. The invention is also operable as a crusher sizing device that comminutes mined ore into granular material and crushes oversized rock and other large lump mineral materials found in situ into and included with the granular material produced from comminution of the ore.

Moreover, the processing apparatus of the present invention is adapted for use to process the produced granular material into a slurry composition for hydrotransport. In the preferred embodiment, the mined ore processing apparatus of the present invention is portable to facilitate moving it from one location to another. Preferably it is adapted to process high volumes of mined ore material in a compact portable facility.

In one of its aspects the invention provides an ore processor bed having an upper surface portion adapted to receive mined ore material to be processed. The ore processor bed has a frame supporting at least two spacedly disposed rotating elements. The mined ore material is placed on the processor bed where it contacts the rotating elements and is processed into granular material as it passes along the processor bed and through the spacing between the rotating elements of the processor bed. Each of the rotating elements is independently operated to rotate in a clockwise or counter clockwise direction and at independent rates. The processor bed is orientable with respect to horizontal to provide a horizontal surface or incline. In one configuration, the mined ore material is contacted with a solvent and supplied to the processor bed. The solvent assists in processing the mined, ore material into granular material and to aid in dust reduction during the process. The solvent may be heated. In another configuration, the mined ore feed material is premixed with a solvent such as water before it is supplied to the processor bed. There are also applications where dry feed is added to the apparatus to produce dry products, that is, no solvent, such as water, is added. In the preferred embodiment, the produced granular material is received in a hopper vessel where solvent such as water is added to form a slurry composition facilitating fluid or hydro transport of the granular material in slurry form.

The preferred embodiments of the invention will now be described with reference to the drawings.

DETAILED DESCRIPTION OF THE PREFERRED EMBODIMENT

Figure 1:
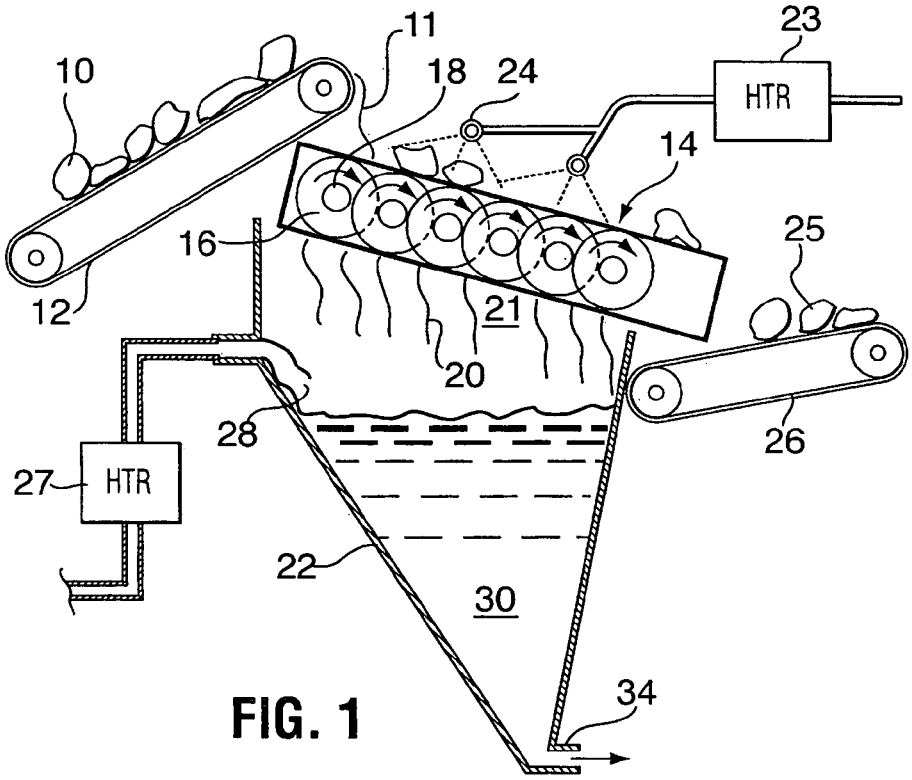
FIG. 1 is an elevation partial cross-section view of the preferred embodiment of the invention.

FIG. 1 shows an elevation partial cross-section view of the preferred embodiment of a mined sand processing facility constructed in accordance with the principles of the invention. Mined ore 10 to be processed, for example oil sands ore, is supplied to a feed conveyor 12. The ore moves along feed conveyor 12 where it is delivered at 11 onto an upper portion surface of an ore processor bed 14. The ore processor bed 14 has plurality of rotating elements 16 in the form of interfitting rotating disk assemblies. Each of the rotating element disk assemblies has a plurality of disks fixed to a driven axle 18. In the operation of the apparatus shown in FIG. 1, each rotating element is operated to rotate in a clockwise direction causing the ore to move along the upper portion of the ore processor bed in a left to right direction. As the ore moves along the upper portion of the ore processor bed, the weight of the ore coming to rest on the disks of rotating disk assemblies causes the finer portions of the ore to separate and fall through the interstitial spaces of the rotating elements of the ore processor bed at 20 into the upper opening 21 of slurry vessel 22.

The ore passing over the upper surface portion of the ore processor bed is preferably contacted with a solvent supply 24, such as a water spray directed toward the ore, to assist in ore disintegration. Preferably, a heater 23 is provided to heat the solvent supply 24 causing heating of the ore to further assist in obtaining disintegration of the ore passing over the ore processor bed. Larger rock and other undesirable oversized materials 25 that are too voluminous to be processed in passage over the ore processor bed 14 are carried to a waste conveyor 26 for disposal. Within slurry vessel 22, the disintegrated ore 20 is mixed with a solvent 28, such as water, to form a slurry solution 30. A heater 27 may be provided to heat the solvent 28 and thus heat the slurry solution. In the preferred embodiment, the lower portion of the slurry vessel has a decreasing cross section relative to the cross section of the upper opening 21 of slurry vessel 22. The decreasing cross section of the slurry vessel permits the force of gravity to urge the slurry solution 30 toward a slurry feed outlet 34 as it passes through the slurry vessel 22. The slurry feed outlet 34 provides an egress path for removing slurry from the slurry vessel by pumping for delivery to a transport pipeline.

Figure 2:
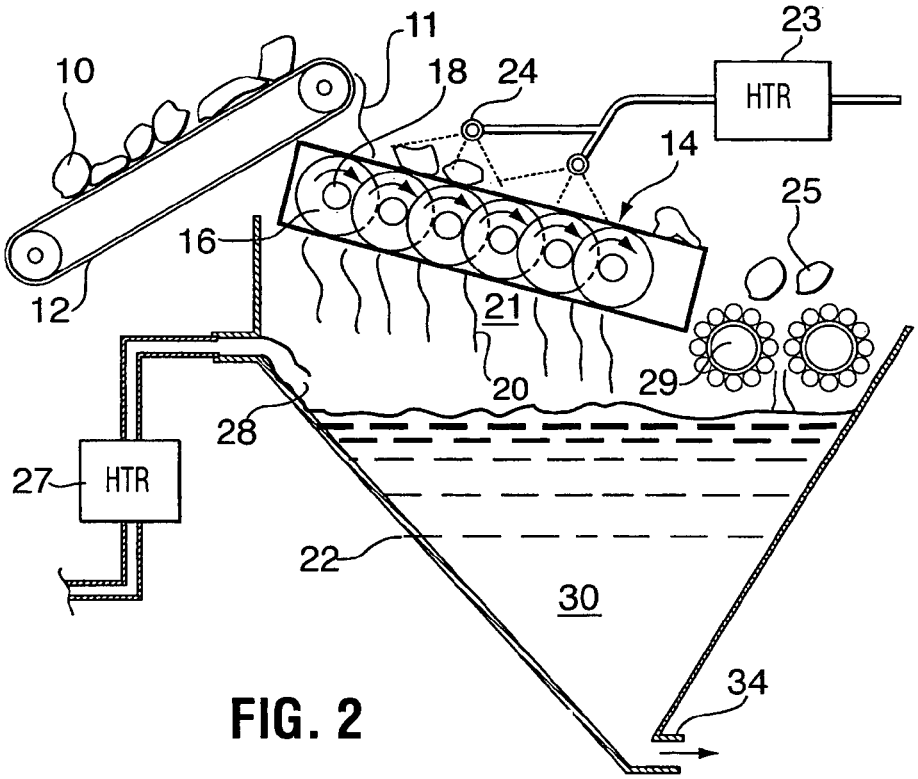
FIG. 2 is an elevation partial cross-section view of an alternate embodiment of the invention including a crusher.

FIG. 2 shows an elevation partial cross-section view of an alternate embodiment of the invention. In the embodiment of FIG. 2, a crusher apparatus 29 is provided to crush the oversize material 25 received from the ore processor bed. The crushed material produced by the crusher is supplied to the slurry vessel 22 and becomes part of the solids included in the slurry solution 30.

Figure 3:
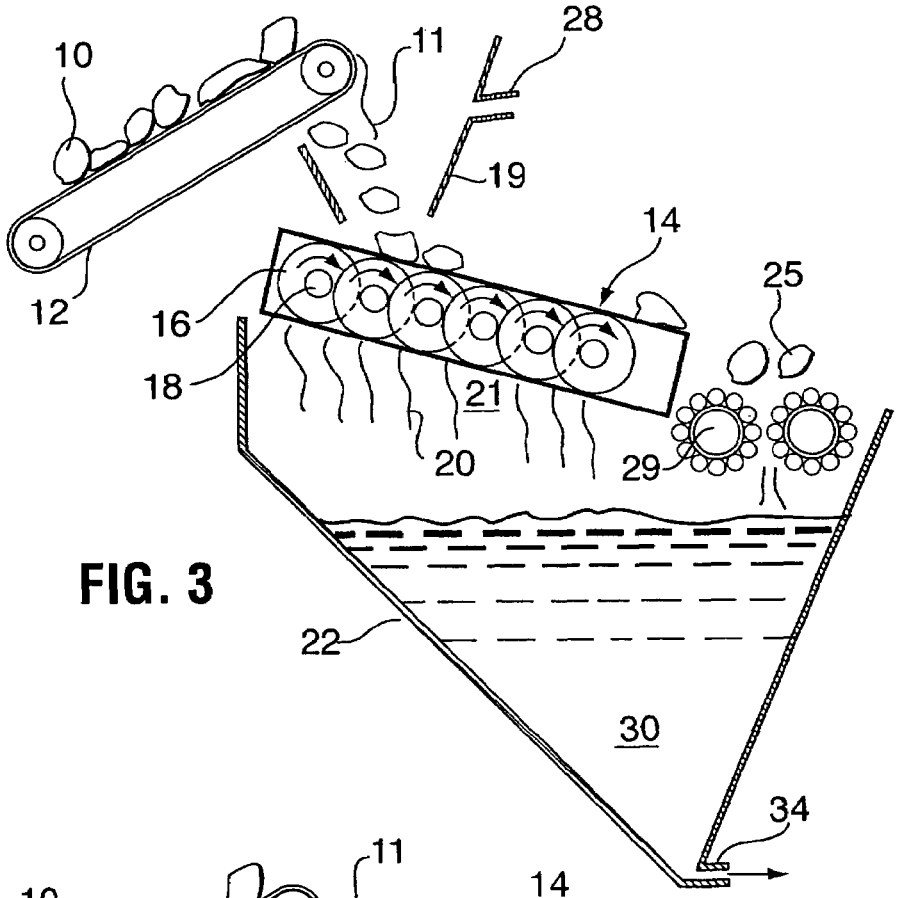
FIG. 3 is an elevation partial cross-section view of an alternate embodiment of the invention providing a feed hopper.

FIG. 3 shows an elevation partial cross-section view of an alternative embodiment of the invention providing a feed hopper 19. In the configuration of FIG. 3, the mined ore 10 is supplied to a feed hopper 19 where it is contacted with a solvent supply 28, such as Water. The solvent and ore intermingle during passage through feed hopper 19 and are discharged from the feed hopper onto the upper portion of an end of the processor bed 14.

Figure 4:
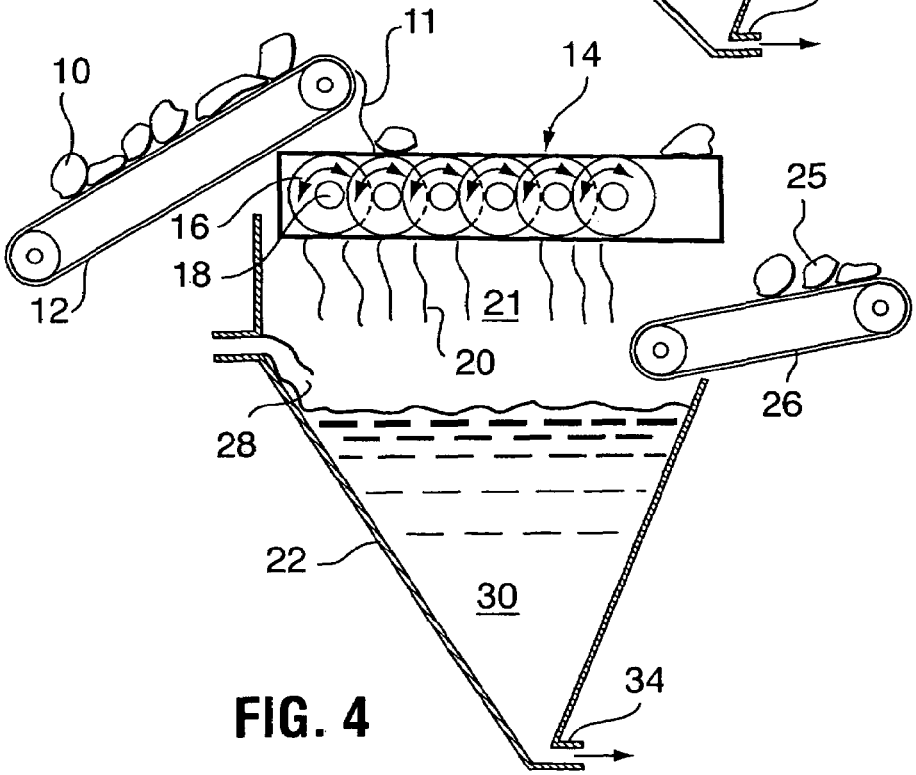
FIG. 4 shows an elevation partial cross-section view of the embodiment of FIG. 1 but in operation without a processor bed solvent supply and with the processor bed oriented horizontally above the slurry vessel.

FIG. 4 shows an elevation partial cross-section view of an alternative embodiment of the invention from that of FIG. 1, wherein the ore processor bed 14 is disposed horizontally above the upper opening 21 of the slurry vessel 22. In this configuration, the ore 10, for example oil sand ore, is passed across the ore processor bed and each of the rotating disk assemblies 16 can rotate in a clockwise or counterclockwise direction as shown by the double-headed arrows. Each rotating disk assembly has a separate drive means 36 as shown more clearly in FIG. 7 which controls the direction and speed of rotation of the coupled rotating disk assembly. The disk assembly drive means 36 is variable speed and reversible permitting the driven disk assembly to rotate in a clockwise or counterclockwise direction at a suitable rate of rotation. Moreover, in the embodiment of FIG. 4 it will be noted that there are no spray nozzles shown as the ore processing can occur with or without a solvent spray being applied to the ore depending on the type of ore that is being processed. In one manner of operation, alternating rotating disk assemblies are turned in opposite directions causing the disk assemblies to apply a pinching or crushing force to the ore to assist in comminution and disintegration of the ore as it passes over ore processor bed 14.

Figure 5:
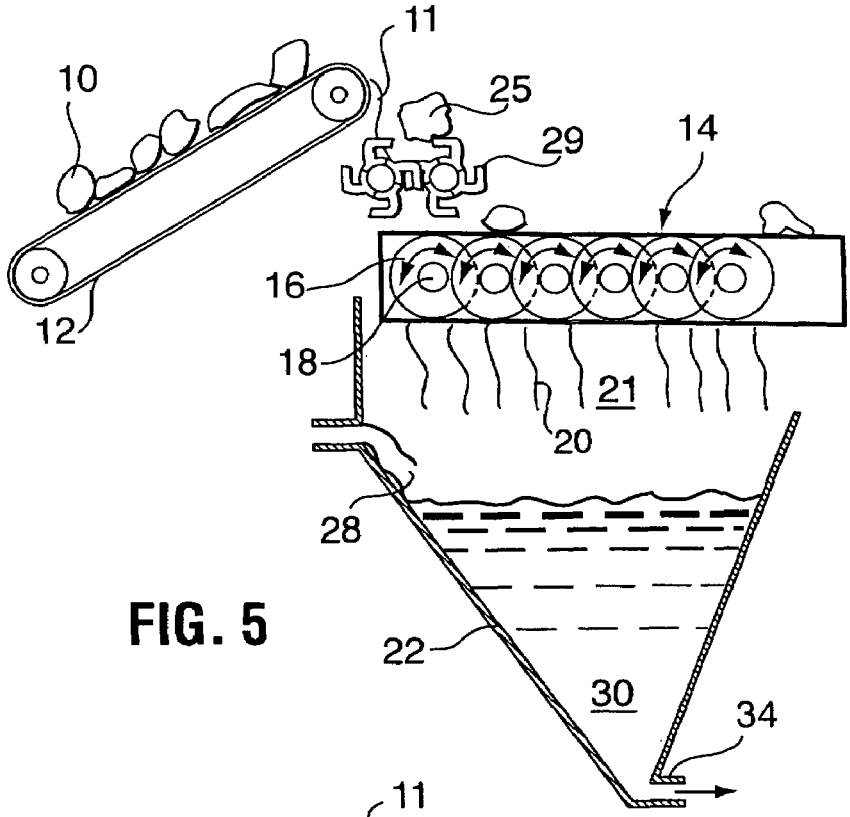
FIG. 5 shows an elevation partial cross-section view of the embodiment of FIG. 2 but in operation without a processor bed solvent supply, with the crusher disposed at the feed end of the processor bed and with the processor bed oriented horizontally above the slurry vessel.

FIG. 5 shows an elevation partial cross-section view of an alternate embodiment of the invention from that depicted in FIG. 2. In the embodiment of FIG. 5, the crusher apparatus 29 is disposed to receive the feed ore and process that ore before delivery to the ore processor bed 14. With the process arrangement of FIG. 5, any oversize material 25 received is crushed before the ore is supplied to the ore processor bed 14.

Figure 6:
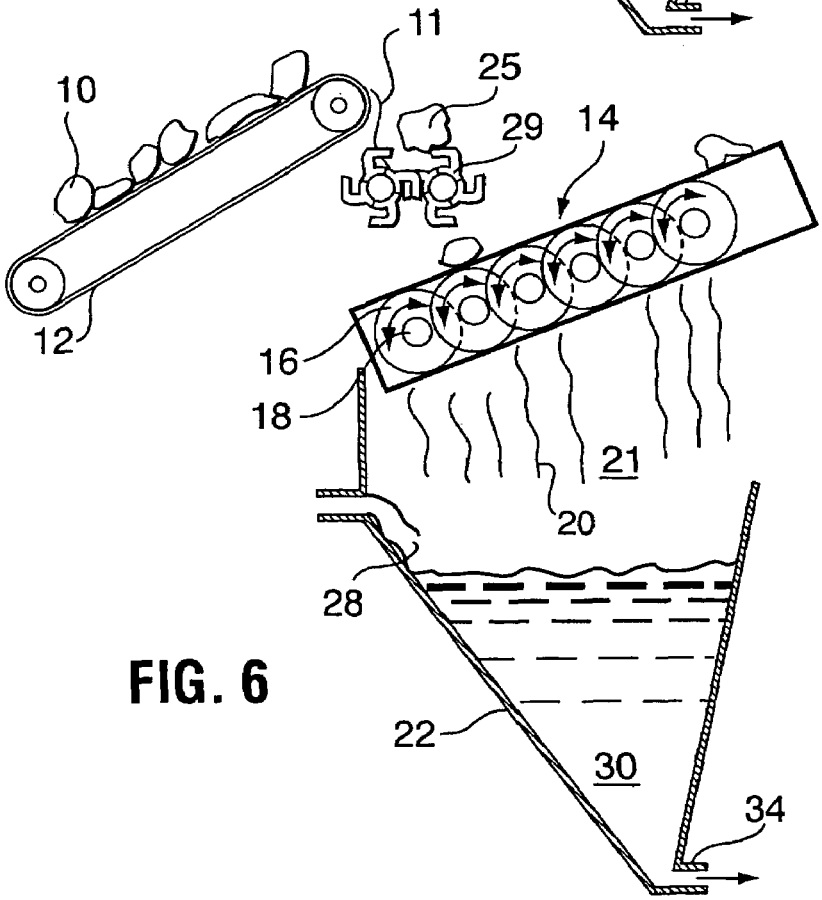
FIG. 6 shows an elevation partial cross-section view of the embodiment of FIG. 5 but with the processor bed oriented at an upward incline above the slurry vessel.

FIG. 6 shows an alternate orientation of the ore processor bed 14 which is oriented to provide an upwardly inclined surface, or a negative declination angle, for the ore 10 that passes over the ore processor bed. Providing a negative declination angle assists the ore processor bed in effecting crushing of the ore, such as oil sands ore, particularly crushing of the oversized materials when the upwardly inclined surface is used in co-operation with alternating rotation directions of the rotating elements of the ore processor bed. Thus, the ore processor bed can be oriented above the slurry vessel at differing inclinations. The ore processor bed can be oriented to provide a downwardly inclined surface, that is a positive declination angle, as shown in FIGS. 1, 2 and 3; a horizontal surface, that is a declination angle of zero, as shown in FIGS. 4 and 5; or an upwardly inclined surface, that is a negative declination angle, as depicted in FIG. 6. Preferably the ore processor bed is configured to provide a declination angle in the preferred range of −30° to +30° relative to horizontal.

Figure 7:
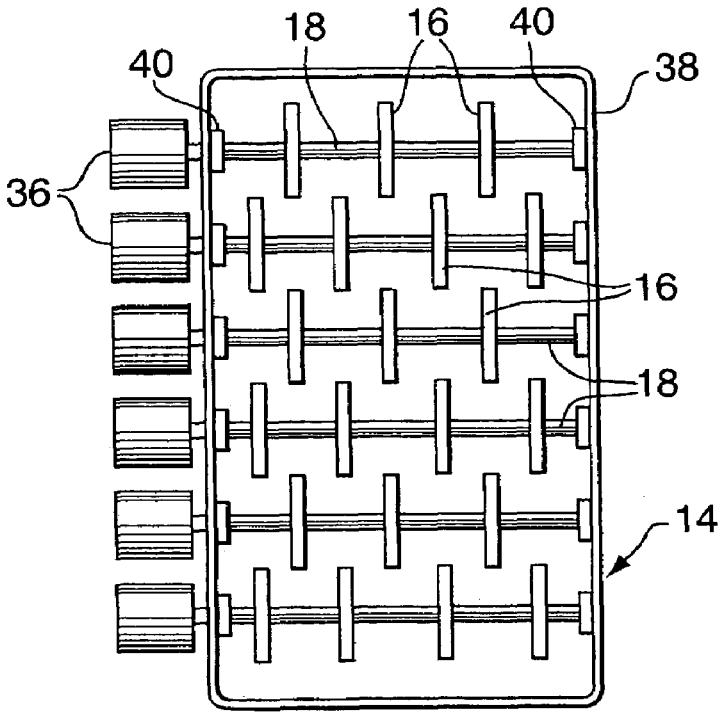
FIGS. 7 and 7*a* are plan views of the ore processor bed rotating elements rotatably disposed therein showing variations in spacings.
Figure 7A:
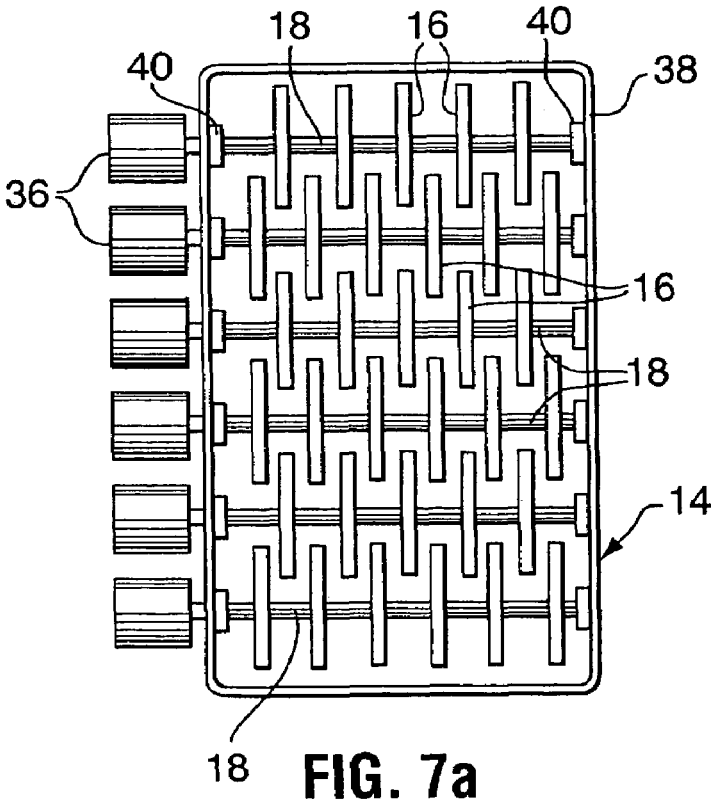

FIG. 7 is a top plan view of an ore processor bed 14 showing the rotating elements in more detail. The rotating elements are provided by an inter-fitting spacing of rotating disk assemblies 16 and each associated drive axle 18 relative to one another. In the preferred arrangement, each rotating disk assembly 16 and drive axle 18 has its own drive means 36. The drive means 36 is variable speed and reversible enabling each disk assembly to rotate in a clockwise or counterclockwise direction depending on the chosen manner of operation for the ore processor bed 14. A frame 38 to which the rotating disk assemblies 16/drive axles 18 are mounted for rotation using bearings 40 supports the rotating disk assemblies 16. FIG. 7*a* shows a variation in spacing of the processor bed rotating elements from the spacing of FIG. 7. In FIG. 7*a*, a reduced inter-fitting spacing of rotating disk assemblies 16 provides for decreasing sized material that will be provided from the ore processor bed.

Preferably where the embodiment of the invention provides a solvent supply, as depicted for example as spray 24 in FIGS. 1 and 2, at least some of the spray nozzles are directed toward processor bed 14 and are operated at sufficient pressure and velocity rates to provide a jet spray cleaning action to clean the rotating elements of material that may tend to clog the ore processor bed.

Figure 8:
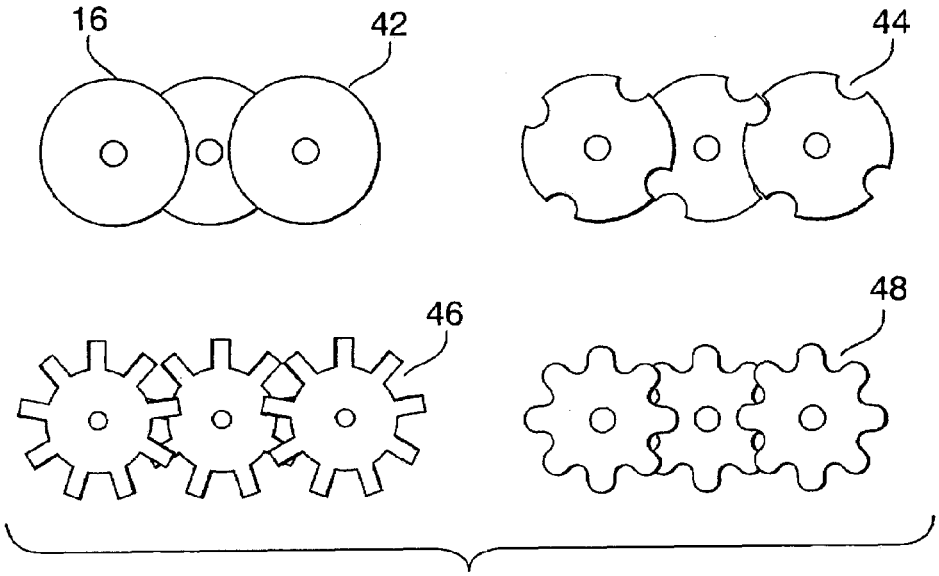
FIG. 8 is an elevation view showing various disk profiles of the rotating element disk assemblies.

FIG. 8 shows a profile view of the rotating disk assemblies 16. They can be configured with various circumference profiles including a round profile 42 which is preferably provided with a roughened circumference to assist in transporting and contacting the oil sand ore along the peripheral circumference of the rotating disk assemblies 16. An alternate circular notch 44 may be spacedly disposed about the circumference of the rotating disk assembly or a toothed circumference 46 may be employed. An alternate sinusoidal circumference 48 may also be provided. As will be understood, it is not necessary for each of the rotating disk assemblies to bear the same profile as all the others. The disk assemblies can include different profiles to assist, in crushing the mined ore, and in ore comminution.

Figure 9:
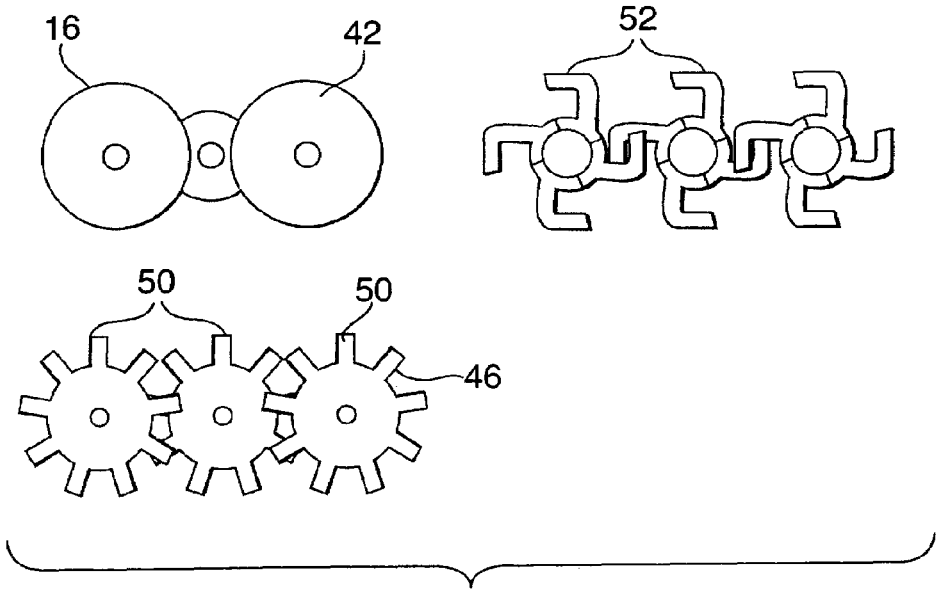
FIG. 9 is an elevation view showing various disk profiles of the rotating element disk assemblies adapted for crushing rock.

FIG. 9 is an elevation view showing various disk profiles of the rotating element disk assemblies adapted for crushing rock. The sizes of the rotating disks can also vary to allow different sizing and size reduction capabilities. This will create variations in the sizing apertures. Elongations 50 or kickers are preferably added to the profile to promote the removal of jammed material from between the disks. The elongations may include a deflection 52 to provide a hammer-like profile for the disks assemblies provided for rock crushing.

Now that the invention has been described numerous substitutions and modifications will occur to those skilled in the art. The invention is not limited to the specific embodiments described here with reference to the drawings but rather is defined in the claims appended hereto.

We claim:

1. An apparatus for forming a slurry of an oil sand ore comprising: (a) a slurry vessel forming an upper opening and having a lower portion; (b) a slurry outlet provided at the lower portion of the slurry vessel; (c) means for delivering water into the slurry vessel; (d) an ore processor bed operative to receive and comminute the oil sand ore and to produce a granular material while screening and sorting the oil sand ore from an oversize material unsuitable for slurry formation in the slurry vessel, the ore processor bed having a frame disposed over the upper opening of the slurry vessel, the frame supporting a plurality of spacedly disposed rotatable elements and drive means for driving the rotatable elements; the frame comprising an elongated upper portion of the ore processor bed formed at least in part by the rotatable elements; and (d) a solvent supply for contacting the oil sand ore with a solvent along the elongated upper portion of the ore processor bed as the oil sand ore is transported by the rotatable elements to comminute the oil sand ore and to produce the granular material while screening and sorting the oil sand ore from the oversize material, the solvent supply comprising a sprayer disposed over and directed towards the elongated upper portion of the ore processor bed, the sprayer operative to spray the solvent towards and along the elongated upper portion of the ore processor bed; and (e) means for supplying the oil sand ore to the ore processor bed;

whereby as the oil sand ore contacts the rotatable elements and the solvent along the frame, the oil sand ore is screened, sorted and comminuted by the ore processor bed to produce the granular material for forming the slurry in the slurry vessel;

and wherein the rotatable elements have a profile selected from the group consisting of: (a) a circular serrate edge profile; (b) a toothed edge profile; and (c) an undulating profile.

2. The apparatus as claimed in claim 1 wherein said solvent is water.

3. The apparatus as claimed in claim 1 wherein the sprayed solvent is provided at sufficient pressure and velocity rates to provide a jet spray cleaning action of the rotating elements.

4. The apparatus as claimed in claim 1 further including a heater for heating the solvent.

5. The apparatus as claimed in claim 1 wherein the ore processor bed is disposed above the slurry vessel at an incline relative to horizontal.

6. The apparatus as claimed in claim 1 wherein the ore processor bed is oriented substantially horizontal.

7. The apparatus as claimed in claim 1 wherein the drive means is adapted to rotate at least one rotatable element at a rotational speed different than a rotational speed of at least one other rotatable element.

8. The apparatus as claimed in claim 1 wherein the drive means is adapted to rotate at least one rotatable element in a direction opposite to other rotatable elements.

9. The apparatus as claimed in claim 1 further including at least one elongate kicker extending radially from at least one of the rotatable elements.

10. The apparatus as claimed in claim 5 wherein the incline ranges between minus 30 degrees and plus 30 degrees.

11. The apparatus as claimed in claim 1 wherein the sprayer comprises a plurality of sprayer elements operative to spray the solvent towards a substantial portion of the ore processor bed as the oil sand ore is transported and comminuted by the rotatable elements from a front end of the ore processor bed towards a back end of the ore processor bed.

12. The apparatus of claim 1 wherein the sprayer is operative to spray the oil sand ore with the solvent over substantially all of the elongated upper portion of the processor bed as the oil sand ore is transported and comminuted by the rotatable elements from a front region of the ore processor bed towards a back region of the ore processor bed.

13. The apparatus as claimed in claim 1 wherein each rotatable element comprises a shaft and a plurality of disks coupled to the shaft, the disks of each shaft inter-fitting with the disks of an adjacent shaft.

14. The apparatus as claimed in claim 13 wherein the sprayer comprises a plurality of sprayer elements operative to spray the solvent onto the oil sand ore over substantially all of the elongated upper portion of the ore processor bed as the oil sand ore is transported and comminuted by the rotatable elements from a front region of the ore processor bed towards a back region of the ore processor bed in a direction generally perpendicular to the shafts of the rotating elements.

15. The apparatus as claimed in claim 13 wherein each of the disks has a profile selected from the group consisting of: a circular serrated edge profile, a tooth edge profile and an undulating profile.

16. The apparatus as claimed in claim 13 wherein the ore processor bed comprises at least six of the rotating elements.

17. The apparatus as claimed in claim 13 wherein the rotatable elements comprise a first set of rotatable elements and a second set of rotatable elements disposed between the first set of rotatable elements, each shaft of the first set of rotatable elements having at least three spaced apart disks, and each shaft of the second set of rotatable elements having at least four spaced apart disks.

18. The apparatus as claimed in claim 13 wherein the rotatable elements comprise a first set of rotatable elements and a second set of rotatable elements disposed between the first set of rotatable elements, each shaft of the first set of rotatable elements having at least five spaced apart disks, and each shaft of the second set of rotatable elements having at least six spaced apart disks.

19. The apparatus as claimed in claim 13 wherein each shaft comprises at least three spaced apart disks coupled to the shaft.

20. The apparatus as claimed in claim 13 wherein each shaft comprises at least four spaced apart disks coupled to the shaft.

21. The apparatus as claimed in claim 13 wherein each shaft comprises at least six spaced apart disks coupled to the shaft.

22. The apparatus as claimed in claim 13 wherein the ore processor bed comprises a receiving end and a discharge end, and wherein the ore processor bed is operative to, while forming the granular material, transport the oversize material along the elongated upper portion from the receiving end to the discharge end.

23. The apparatus as claimed in claim 22 wherein the ore processor bed is operative to receive the oil sand ore solely near the receiving end of the ore processor bed.

24. The apparatus as claimed in claim 22 further comprising a crusher operative to crush oversize material in the form of the oversize material that does not pass through the ore processor bed.

25. The apparatus as claimed in claim 1 wherein:

(a) the ore processor bed comprises at least four rotatable elements disposed in general alignment with each other to form a layer, wherein each rotatable element comprises a shaft and a plurality of disks coupled to the shaft, the disks of each shaft inter-fitting with the disks of an adjacent shaft, each of the disks having a profile selected from the group consisting of: a circular serrated edge profile, a tooth edge profile and an undulating profile, and wherein the rotatable elements further comprise a first set of rotatable elements and a second set of rotatable elements disposed between the first set of rotatable elements, each shaft of the first set of rotatable elements having at least three spaced apart disks, and each shaft of the second set of rotatable elements having at least four spaced apart disks; and (b) the sprayer comprises a plurality of sprayer elements operative to spray the solvent generally evenly towards a substantial portion of the ore processor bed as the oil sand ore is transported and comminuted by the rotatable elements from a front end of the ore processor bed towards a back end of the ore processor bed in a direction generally perpendicular to each shaft.

* * * * *